United States Patent [19]

Yangas

[11] Patent Number: 4,539,454

[45] Date of Patent: Sep. 3, 1985

[54] METHOD AND MEANS FOR IMPROVING MICROWAVE COOKING

[76] Inventor: Roger Yangas, 14000 Citation Dr., Orland Park, Ill. 60642

[21] Appl. No.: 652,897

[22] Filed: Sep. 21, 1984

[51] Int. Cl.[3] ..... H05B 6/64

[52] U.S. Cl. ..... 219/10.55 F; 219/10.55 E; 219/10.55 R; 99/DIG. 14; 426/243

[58] Field of Search ..... 219/10.55 F, 10.55 E, 219/10.55 M, 10.55 R, 10.55 B; 426/234, 241, 243; 99/451, DIG. 14

[56] References Cited

U.S. PATENT DOCUMENTS 3,316,380 4/1967 Pansing ..... 219/10.55 F
4,144,435 3/1979 Clark et al. ..... 219/10.55 E
4,144,438 3/1979 Gelman et al. ..... 219/10.55 E
4,228,334 10/1980 Clark et al. ..... 219/10.55 F X
4,316,070 2/1982 Prosise et al. ..... 219/10.55 E

*Primary Examiner*—Philip H. Leung
*Attorney, Agent, or Firm*—Silverman, Cass & Singer, Ltd.

[57] ABSTRACT

This invention relates to a new device for faster and more thorough cooking employing a series of power cells wherein the microwaves in the oven strike a series of mirrored surfaces above the floor of the housing which are provided with pivots secured to a housing and spaced therefrom and a tube depending from a clear, nonflexible, plastic plate, and the cells are placed above the bottom wall of the oven to reflect the rays to the material being cooked.

7 Claims, 6 Drawing Figures

METHOD AND MEANS FOR IMPROVING MICROWAVE COOKING

BACKGROUND OF THE INVENTION AND RELATED APPLICATION

This invention is an improvement of my copending application Ser. No. 550,464 filed Nov. 10, 1983, for Method and means for improving microwave cooking.

This invention decreases the food cooking time and cooks the food more thoroughly, thus conserving energy.

SUMMARY OF THE INVENTION

A series of spaced, individual cells are used above the floor of a microwave oven. Each cell has a pair of styrofoam housings, one on the other with the upper one having its lower portion partially hollowed out and containing a square aperture communicating therewith, the lower one being substantially all hollowed out to house a power cell of flexible material containing a lightweight, very porous sponge containing a minute amount of water and an enclosed medial pouch supporting said sponge, the upper styrofoam housing having four truncated, triangular-like, mirrored surfaces hinged to the top wall thereof in spaced relation thereto and positioned above the top wall of the upper housing, a pair of stiff plastic, spaced walls, one on the lower face of the bottom wall and the other above the upper wall of the upper housing, the upper housing having a depending heat sensing tube positioned thereon having a square in horizontal cross-section upper end to prevent arcing and a cylindrical tube therebelow which extends through the lower housing and into the power cell whereby when the microwave oven is energized, the water in the sponge will quickly heat up to steam, expanding the sponge and raising the tube and upper housing upwardly to flatten the truncated triangular reflectors against the lower face of the nonflexible plate to transmit microwaves into the cooking vessel or the food if no vessel is used to cook them faster. The flattening of the reflectors requires only from 45 to 60 seconds in the presence of microwaves to react.

DETAILED DESCRIPTION OF THE DRAWINGS

Figure 3:
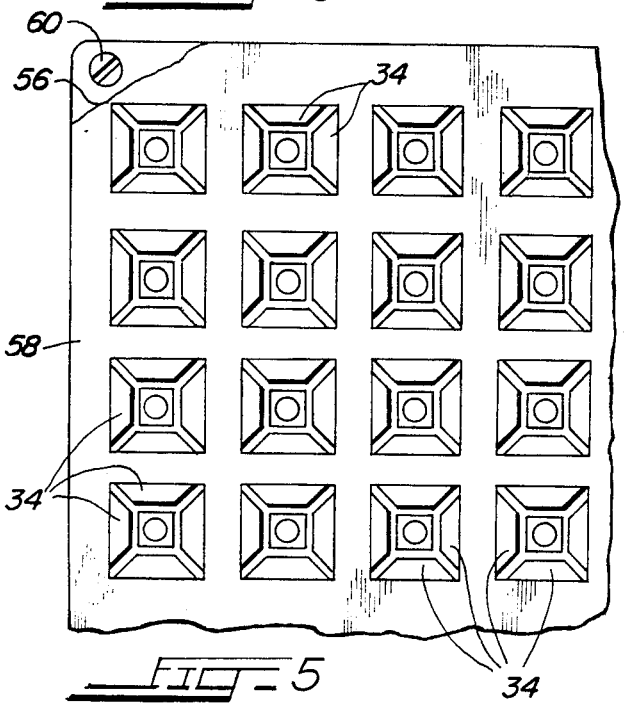
FIG. 3 is a top plan view of a multiple series of cells as used to cover the bottom of a microwave oven with parts broken away.
Figure 5:
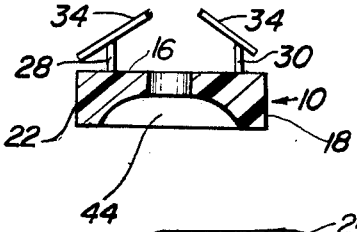
FIG. 5 is a cross-sectional view taken on the line 5—5 of the upper housing shown in FIG. 1.

In the device of the present invention, a series of cells are employed as seen in FIG. 3, but since all cells are alike, only one cell will be described. Each cell has a pair of housings 10, 12, one above the other. Each housing is substantially square in horizontal cross-section. The upper housing is provided with a square in horizontal cross-section opening or aperture 14 and provided with a top wall 16, and four side walls 18, 20, 22, 24. The housings are preferably constructed of styrofoam, but any nonmetallic material may be used. The top wall 16 adjacent the walls 18, 20, 22, 24 are each provided with a hinge 26, 28, 30, 32, substantially rigid in construction and vertically extending each to hingedly support a truncated, triangular, mirror-like piece of reflective aluminum 34, although any mirror-like material could be used. The truncated triangular pieces are positioned slightly angularly inwardly from the vertical and the upper portions 36, 38, 40 and 42 thereof extend slightly inwardly, the reasons therefor will be hereinafter understood. The hinges 26–32 are secured to the upper surface of the housing 10 slightly inwardly of the edges of the top 16 and side walls 18–24. The reflector pieces are pivotally secured to the upper ends of the hinges medially of the pieces 34, as seen in FIG. 5. The lower medial portion of the upper housing is cut out as at 44.

The lower housing 12 is cut away medially at 46 to house a latex rubber pouch 48 containing a very porous sponge 50 and a very small amount of water, in the neighborhood of 4 cc. The pouch is so formed that the medial area thereof forms a pocket 52 and the lower end of the pouch is secured to the bottom wall 54 of the lower housing 12.

Figure 1:
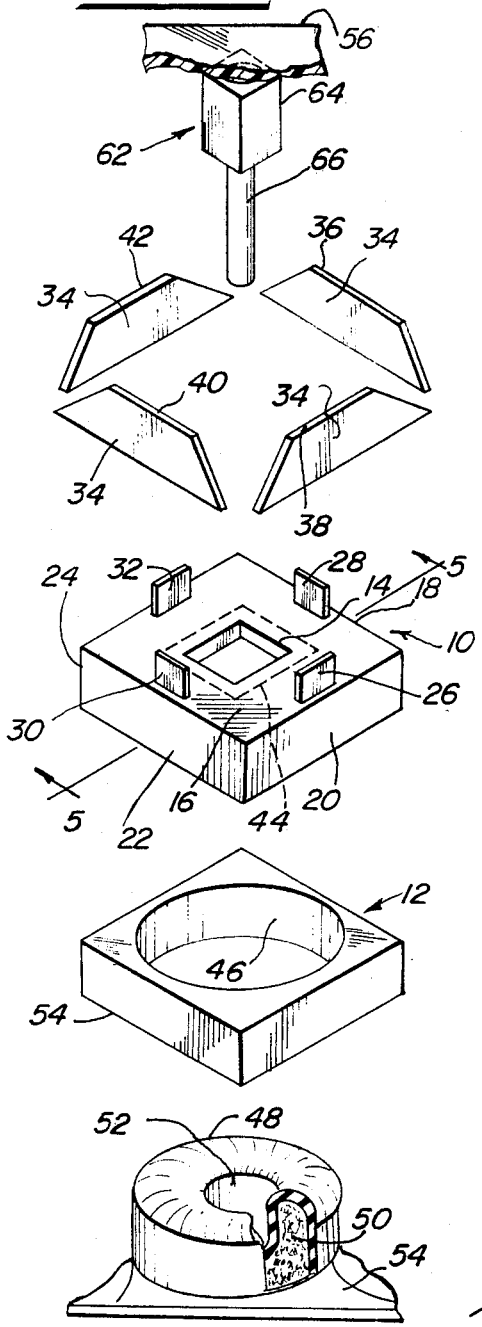
FIG. 1 is an exploded view of one cell of the present invention.
Figure 2:
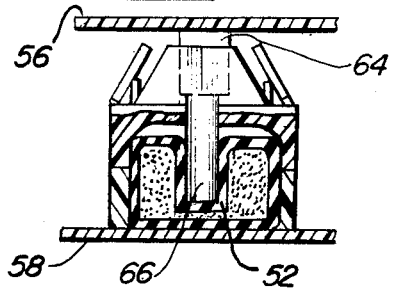
FIG. 2 is a side elevational view of the completed device, parts being shown in cross-section.

A pair of nonresilient plates 56, 58 are positioned one plate 56 above the upper housing 10 and the other plate 58 supporting the housing 12, as shown in FIG. 2. The plates 56, 58 are held in position by posts 60 at each of the corners of the plates.

A cylindrical heat sensing tube 62 depends and is anchored to the lower side of plate 56. A plastic square in horizontal cross-section portion 64 is affixed at the upper end of the tube and is slidingly engaged in the aperture 14 in the upper housing 10. The lower end of the tube 66 partially seats in the pocket 52 of the pouch 48.

Figure 4:
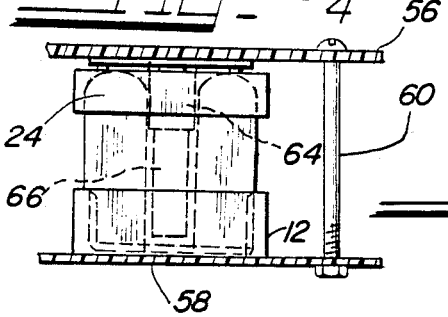
FIG. 4 is a side elevational view of the completed device during a heating operation.

In operation, when the device is placed above the floor of the oven and the microwave is energized, the microwaves will bounce off the floor and will almost instantly (45 to 60 seconds) turn the water in the sponge into steam, causing the sponge to swell and expand upwardly and shifting the pocket and the lower end of the tube 52 and the pouch 48 upwardly causing the reflective pieces 34 to contact the lower side of plate 56 and to shift inwardly about their respective pivot so that the pieces 34 lie flat against the lower side of the plate 56, as shown in FIG. 4. Thus the microwaves will bounce off the pieces 34 and be redirected so as to penetrate parts of the food which are undercooked.

It should be noted that in both positions, the pieces 34 are spaced apart from each other at least one-eighth inch at all times to prevent arcing.

Now, when a series of these cells in their plates are placed together in the microwave oven, the cooking time is greatly lessened and the product will be more thoroughly cooked throughout. Microwave ovens rarely thoroughly cook the product, usually only the outer sides and edges, in the normal cooking time and therefore it was to overcome this problem that applicant conceived the present invention.

Figure 6:
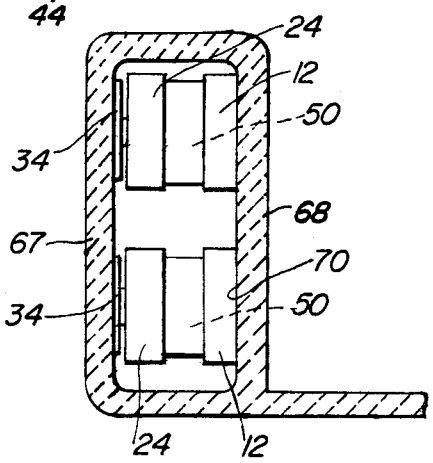
FIG. 6 is a modification shown in partial cross-section with parts broken away.

A modified structure is disclosed in FIG. 6 wherein the cells are incorporated in a cooking pan, dish or pot wherein it is provided with a pair of spaced side walls 68 and the cell minus the plates 56, 58 and heat sensor and tubes 64, 66. The bottom wall of the housing 12 is fixed to the inside side wall 68. Upon energization of the microwave oven, the water will expand causing the sponge to expand the rubber and force the upper housing to flatten the mirror pieces against the outer wall, thus redistributing the microwaves so as to more thoroughly cook the food and conserving energy.

The power curve is that part of the oven in which the greatest number of microwaves intersect one another in a heat generating state. The location of the power curve is variable in accordance with the construction of the oven by the manufacturer. The cells are placed in the power curve and must be installed at least one inch above the metal interior floor of the oven.

It is to be understood that numerous details of the invention may be altered or omitted as defined by the following claims.

I claim:

1. A power heat cell for increasing the cooking rate of food in a microwave oven having means to produce microwaves, said power cell comprising a lower hollowed out housing of styrofoam having a bottom wall, a flexible pouch housed within said hollowed out portion, a porous sponge therein, a small amount of water in said sponge, an upper, substantially square in horizontal cross-section, styrofoam housing having a medial through aperture therein and having a top, side and bottom walls, the bottom wall of said upper member being partially hollowed out, four aluminum mirror-like pieces each of truncated triangular shape each extending upwardly from said top substantially less than vertical and pivoted to the top wall of said upper member adjacent the respective side walls and away from said top wall, each piece spaced from adjacent pieces to prevent arcing in the presence of microwaves, a clear plastic top plate, an aluminum tube having a top and bottom, the top of said tube secured to a plastic square in cross-section portion and said portion attached to and depending from said plate, said portion extending through said aperture in said upper member with the bottom portion of said tube extending partially in said flexible pouch and sponge whereby when cooking food the heat and rays from the microwave will heat the water quickly in said pouch causing said pouch to expand upwardly into the hollowed out bottom of said upper member and causing said four aluminum shields to close horizontally against the plastic top, but with the side edges of each triangle being spaced from each other, and to redirect microwaves to reflect heat upwardly to cook the food evenly and quicker.

2. The power cell according to claim 1 wherein the flexible pouch has a portion to seat around the lower end of said tube and sponge.

3. The power cell according to claim 2 wherein a portion of said pouch is anchored to the bottom of said lower housing and provided with a lower plastic wall.

4. The power cell according to claim 1 wherein a series of cells are placed above the bottom wall of a microwave oven in substantially side-by-side relationship with the pieces of each cell spaced apart.

5. The power cell according to claim 4 wherein a single plastic top covers all the cells and supports the depending tubes.

6. The power cell according to claim 5 wherein the spacing between each individual truncated triangular piece is approximately 0.125 inches and separated from adjacent cells the same distance.

7. A pan suitable for use in a microwave oven having means for producing microwaves, said pan having spaced side walls and a plurality of power cells secured between said side walls, each of said power cells comprising a lower hollowed out housing of styrofoam having a bottom wall, a flexible pouch housed within said hollowed out portion, a porous sponge therein, a small amount of water in said sponge, an upper, substantially square in horizontal cross-section, styrofoam housing having a medial through aperture therein and having a top, side and bottom walls, the bottom wall of said upper member being partially hollowed out, four aluminum mirror-like pieces each of truncated triangular shape each extending upwardly from said top substantially less than veritcal and pivoted to the top wall of said upper member adjacent the respective side walls and away from said top wall, each piece spaced from adjacent pieces to prevent arcing in the presence of microwaves, a clear plastic top plate, an aluminum tube having a top and bottom, the top of said tube secured to a plastic square in cross-section portion and said portion attached to and depending from said plate, said portion extending through said aperture in said upper member with the bottom portion of said tube extending partially in said flexible pouch and sponge whereby when cooking food the heat and rays from the microwave will heat the water quickly in said pouch causing said pouch to expand upwardly into the hollowed out bottom of said upper member and causing said four aluminum shields to close horizontally against the plastic top, but with the side edges of each triangle being spaced from each other, and to redirect microwaves to reflect heat upwardly to cook the food evenly and quicker.

* * * * *